US010991568B2

(12) United States Patent
Xu et al.

(10) Patent No.: US 10,991,568 B2
(45) Date of Patent: Apr. 27, 2021

(54) ION RESONANCE EXCITATION OPERATION METHOD AND DEVICE BY APPLYING A QUADRUPOLAR ELECTRIC FIELD COMBINED WITH A DIPOLAR ELECTRIC FIELD

(71) Applicant: BEIJING INSTITUTE OF TECHNOLOGY, Beijing (CN)

(72) Inventors: Wei Xu, Beijing (CN); Ting Jiang, Beijing (CN); Qi Guo, Beijing (CN); Qian Xu, Beijing (CN)

(73) Assignee: BEIJING INSTITUTE OF TECHNOLOGY, Beijing (CN)

( * ) Notice: Subject to any disclaimer, the term of this patent is extended or adjusted under 35 U.S.C. 154(b) by 0 days.

(21) Appl. No.: 16/531,233

(22) Filed: Aug. 5, 2019

(65) Prior Publication Data

US 2020/0043715 A1 Feb. 6, 2020

(51) Int. Cl.
*H01J 49/42* (2006.01)
*H01J 49/00* (2006.01)

(52) U.S. Cl.
CPC ..... *H01J 49/4225* (2013.01); *H01J 49/4235* (2013.01); *H01J 49/0013* (2013.01); *H01J 49/427* (2013.01); *H01J 49/4285* (2013.01)

(58) Field of Classification Search
CPC ..... H01J 49/0013; H01J 49/4225; H01J 49/4285; H01J 49/427; H01J 49/4235
See application file for complete search history.

(56) References Cited

U.S. PATENT DOCUMENTS 5,438,195 A * 8/1995 Franzen ..... H01J 49/424 250/282
5,468,957 A * 11/1995 Franzen ..... H01J 49/424 250/282
5,572,025 A * 11/1996 Cotter ..... H01J 49/0009 250/282
5,710,427 A * 1/1998 Schubert ..... H01J 49/424 250/282
6,900,433 B2 * 5/2005 Ding ..... H01J 49/424 250/282
2004/0079875 A1 * 4/2004 Ding ..... H01J 49/424 250/282
2005/0067564 A1 * 3/2005 Douglas ..... H01J 49/4215 250/290
2005/0279932 A1 * 12/2005 Wang ..... H01J 49/4225 250/290

(Continued)

*Primary Examiner* — Wyatt A Stoffa
(74) *Attorney, Agent, or Firm* — Yong Chen

(57) ABSTRACT

An ion resonance excitation operation method and device by applying a quadrupolar electric field combined with a dipolar electric field. The method includes applying a main RF to any pair of plates of the ion trap mass analyzer, and applying a quadrupolar excitation signal to any pair of plates, and applying a reverse phase dipolar excitation signal to any pair of plates. Also provided is an ion resonance excitation operation method and device by using a quadrupolar electric field combined with a dipolar electric field, which includes applying a positive main RF to a pair of electrode rods of the quadrupole, and applying a negative main RF to the other pair of electrode rods; applying a quadrupolar excitation signal to any pair of electrode rods, applying a reverse phase dipolar excitation signal to any pair of electrode rods.

7 Claims, 11 Drawing Sheets

(56) References Cited

U.S. PATENT DOCUMENTS

| | | | | |
|---|---|---|---|---|
| 2009/0294646 | A1* | 12/2009 | Baba | H01J 49/4225 250/282 |
| 2015/0255263 | A1* | 9/2015 | Kodera | H01J 49/424 250/283 |
| 2015/0303047 | A1* | 10/2015 | Jiang | H01J 49/4225 250/283 |
| 2019/0013194 | A1* | 1/2019 | Dang | H01J 49/0063 |
| 2020/0161121 | A1* | 5/2020 | Langridge | H01J 49/022 |
| 2020/0203142 | A1* | 6/2020 | Langridge | H01J 49/065 |

* cited by examiner

ION RESONANCE EXCITATION OPERATION METHOD AND DEVICE BY APPLYING A QUADRUPOLAR ELECTRIC FIELD COMBINED WITH A DIPOLAR ELECTRIC FIELD

TECHNICAL FIELD

The invention relates to the technical field of mass spectrometry mass analysis, in particular to an ion resonance excitation operation method and device by applying a quadrupolar electric field combined with a dipolar electric field.

BACKGROUND ART

Resonance excitation techniques are widely used in mass spectrometry operations. Commonly used resonant excitation techniques are dipolar resonance excitation and quadrupolar resonance excitation. Dipolar resonance excitation is to apply a pair of reverse phase voltages on a quadrupole mass analyzer. The quadrupolar resonance excitation is applied in the same way as the main Radio Frequency (RF in short). The signal of the opposite electrode is in-phase signal, and has lower frequency and amplitude than those of the main RF. The quadrupolar excitation electric field divides the stable region formed by the main RF into islands of stability, so that the original stable region becomes an unstable region, thereby realizing ion excitation.

However, for a miniature mass spectrometer, the working pressure is higher than that of a commercial large instrument, and the resolution of the instrument is degraded under the action of the buffer gas, resulting in a lower resolution with the increase of air pressure.

SUMMARY OF THE INVENTION

In order to overcome the above technical problems, the present invention provides an ion resonance excitation operation method and device by applying a quadrupolar electric field combined with a dipolar electric field, which has better excitation efficiency and improves the resolution and sensitivity of the instrument.

In order to achieve the above object, the present invention provides an ion resonance excitation operation method by applying a quadrupolar electric field combined with a dipolar electric field for an ion trap mass analyzer, comprising:

applying a main RF to any pair of plates of the ion trap mass analyzer; and applying a quadrupolar excitation signal to any pair of plates and applying a reverse phase dipolar excitation signal to any pair of plates.

In an alternative embodiment, the amplitude of said quadrupolar excitation signal is from 0.1% to 1.2% of the amplitude of said main RF.

In an alternative embodiment, the amplitude of said quadrupolar excitation signal is from 0.8% to 1.2% of the amplitude of said main RF.

In an alternative embodiment, the frequency of the quadrupolar excitation signal is 1/n of the frequency of the main RF, and n is an integer greater than one.

In an alternative embodiment, the frequency of the dipolar excitation signal is within +/−3 k Hz of the frequency corresponding to the unstable region generated by the quadrupolar excitation signal.

The invention also provides an ion resonance excitation operation method by applying a quadrupolar electric field combined with a dipolar electric field for a quadrupole, comprising:

applying a positive main RF to a pair of electrode rods of the quadrupole and applying a negative main RF to the other pair of electrode rods; and applying a quadrupolar excitation signal to any pair of electrode rods and applying a reverse phase dipolar excitation signals to any pair of electrode rods.

The invention also provides an ion resonance excitation device having a quadrupolar electric field combined with a dipolar electric field, comprising:

Ion trap mass analyzer, main RF, quadrupolar excitation signal source, dipolar excitation signal source;

wherein the main RF is applied to any pair of plates of the ion trap mass analyzer; the quadrupolar excitation signal source and the dipolar excitation signal source are applied to any pair of plates of the ion trap mass analyzer, respectively.

The invention also provides an ion resonance excitation device by applying a quadrupolar electric field combined with a dipolar electric field, comprising:

quadrupole, positive main RF, negative main RF, quadrupolar excitation signal source, dipolar excitation signal source;

wherein the positive main RF is applied to a pair of electrode rods of the quadrupole, and the negative main RF is applied to the other pair of electrode rods of the quadrupole; the quadrupolar excitation signal source and the dipolar excitation signal sources are applied to any pair of electrode rods of the quadrupole, respectively.

The ion resonance excitation operation method by applying a quadrupolar electric field combined with a dipolar electric field according to the present invention is used for an ion trap mass analyzer, and the method comprises: applying a main RF to a pair of plates of the ion trap mass analyzer, and applying a quadrupolar excitation signal to any pair of plates and applying a reverse phase dipolar excitation signal to any pair of plates. The solution achieves quadrupole enhanced dipole resonance, which has higher excitation efficiency than the conventional solution, has an inhibitory effect on the peak broadening effect caused by high air pressure, improves the detection sensitivity and resolution of the mass spectrometer equipment, especially the miniature mass spectrometer, and expands the range of applications of miniature mass spectrometers. The ion resonance excitation operation method by applying a quadrupolar electric field combined with a dipolar electric field according to the present invention can also be applied to a quadrupole to improve its resolution.

DESCRIPTION OF THE DRAWINGS

FIG. 3(*b*) is a spectrum analysis diagram;

FIGS. 3(*c*), 3(*d*), and 3(*e*) are simulation diagrams of ion trajectories;

DETAILED DESCRIPTION OF EMBODIMENTS

The examples of the present invention are illustrated below with the aid of the drawings. Elements and features described in one drawing or one embodiment of the present invention may be combined with elements and features described in one or more other drawings or embodiments. It should be noted that for the purpose of clarity, expressions and descriptions of components or processes that are well known to those skilled in the art and are not pertinent to the present invention are omitted from the drawings and the description.

Figure 1:
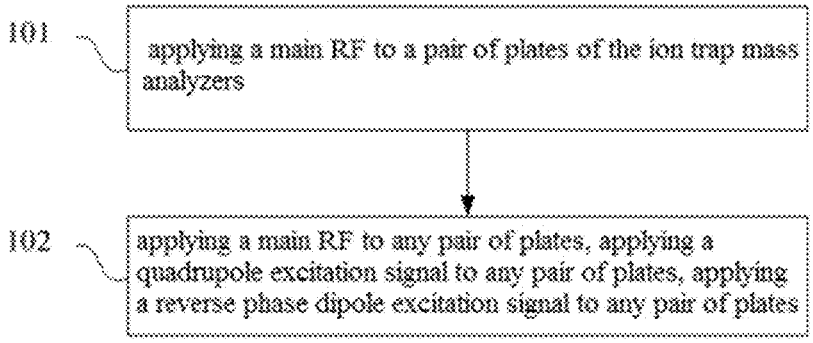
FIG. 1 is a flowchart showing the ion resonance excitation operation method by applying a quadrupolar electric field combined with a dipolar electric field according to the present invention.

An example of the present invention provides an ion resonance excitation operation method by applying a quadrupolar electric field combined with a dipolar electric field, which is used for an ion trap mass analyzer, as shown in FIG. 1, the method comprises (the recited steps can be performed in any order or simultaneously):

101. applying a main RF to a pair of plates of the ion trap mass analyzer;

102. applying a quadrupolar excitation signal to any pair of plates and applying a reverse phase dipolar excitation signal to any pair of plates.

wherein the amplitude of the quadrupolar excitation signal is from 0.1% to 1.2% of the amplitude of the main RF. Preferably, the amplitude of the quadrupolar excitation signal is from 0.8% to 1.2% of the amplitude of the main RF.

The frequency of the quadrupolar excitation signal is 1/n of the frequency of the main RF, and n is an integer greater than one.

Further, the dipolar excitation signal frequency corresponds to the quadrupolar excitation frequency. Specifically, the range of the dipolar excitation signal frequency is within +/−3 k Hz of the frequency corresponding to the unstable region generated by the quadrupolar excitation signal.

Figure 2A:
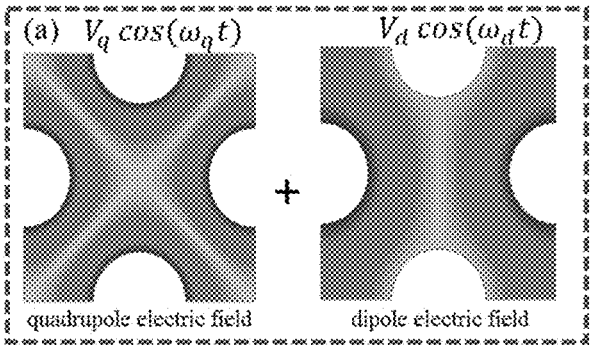
FIGS. 2(*a*) to 2(*b*) are field-shaped distribution diagrams and electrical signal connection diagrams of the quadrupolar electric field and the dipolar electric field according to the present invention.
Figure 2B:
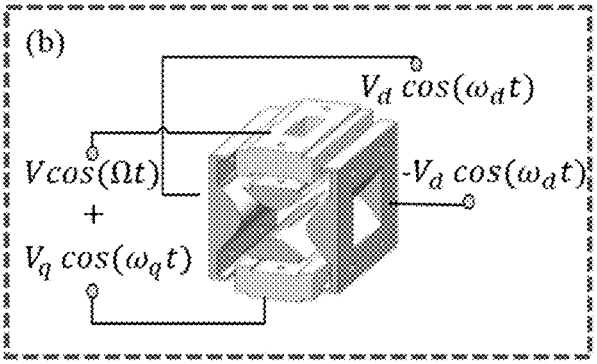
Figure 3A:
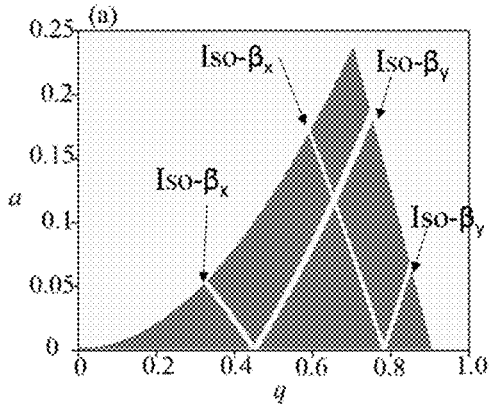
FIG. 3(*a*) is a schematic diagram of a stable region and an unstable region generated by quadrupolar excitation.
Figure 3B:
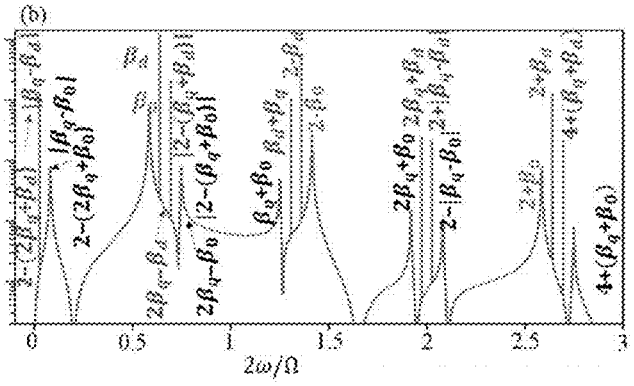
Figure 3C:
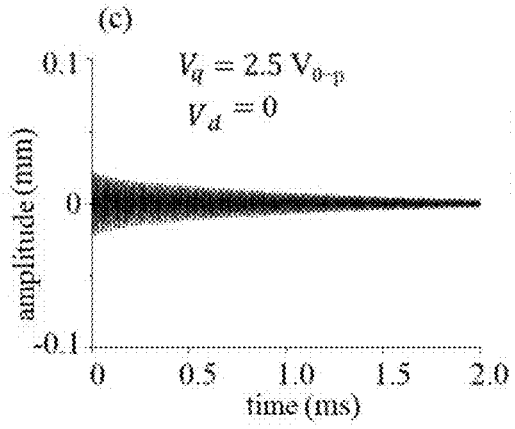
Figure 3D:
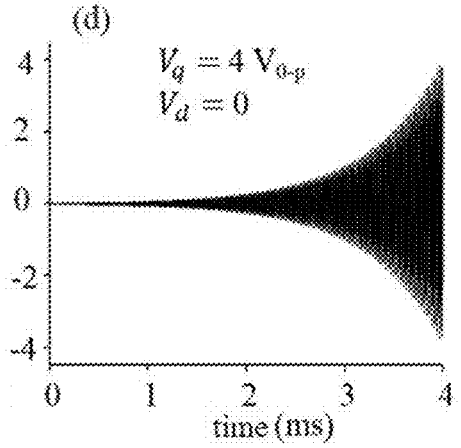
Figure 3E:
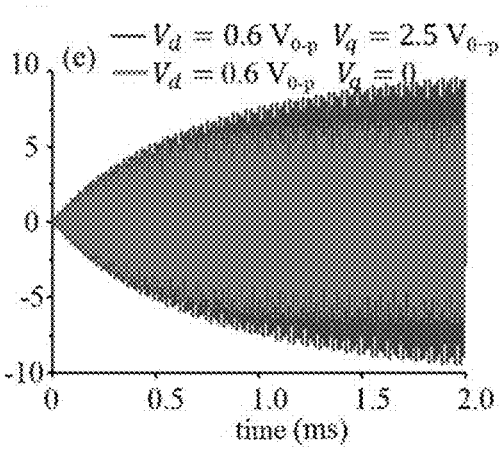

Correspondingly, an example of the invention further provides an ion resonance excitation device by applying a quadrupolar electric field combined with a dipolar electric field, comprising: an ion trap mass analyzer, a main RF, a quadrupolar excitation signal source, and a dipolar excitation signal source. The main RF is applied to any pair of plates of the ion trap mass analyzer, and the quadrupolar excitation signal source and the dipolar excitation signal source are respectively applied to any pair of plates of the ion trap mass analyzer. A specific structure is shown in FIG. 2(*b*). A main RF V cos(Ωt) is applied to a pair of plates in the vertical direction, and a reverse phase dipolar excitation signal $V_d \cos(\omega_d t)$ is applied to a pair of plates in the horizontal direction, and a quadrupolar excitation signal $V_q \cos(\omega_q t)$ is applied to a pair of electrode rods in the vertical direction.

The ion resonance excitation operation method and device by applying a quadrupolar electric field combined with a dipolar electric field provided by the examples of the invention can be used for the ion trap mass analyzer, realizing the quadrupolar enhanced dipole resonance, improving the sensitivity of the instrument, having an inhibitory effect on the peak broadening effect caused by the high pressure, improving the detection sensitivity and resolution of mass spectrometry devices, especially miniature mass spectrometers, and broadening the application range of miniature mass spectrometers.

The quadrupolar electric field intensity required by the solutions of the examples of the invention is small, and the quadrupolar electric field is used to assist the dipolar resonance excitation. The solutions of the examples of the present invention can suppress the resolution reduction due to the space charge effect.

FIG. 2(*a*) shows the field distribution of the quadrupolar electric field and the dipolar electric field, and FIG. 2(*b*) shows the connection diagram of the electric signal, wherein the connection of the auxiliary quadrupolar excitation signal is consistent with the connection of the main RF, and the quadrupolar excitation signal can be coupled to the main RF; the dipolar excitation signal is applied by applying a pair of reverse phase signals to a pair of opposite plates; the quadrupolar excitation signal is $V_q \cos(\omega_q t)$, and the dipolar excitation signal is $V_d \cos(\omega_d t)$.

The examples of the invention are analyzed in perspective of theory. The motion of an ion in an ideal quadrupolar electric field at high pressure satisfies the Mathieu equation.

$$\frac{d^2u}{d\xi^2} + c\frac{du}{d\xi} + (a - 2q\cos(2\xi) - 2q'\cos(2\nu'\xi))u = A\cos(2\nu\xi)$$

$$a = \frac{8eU}{mr_0^2\Omega^2},\ q = \frac{4eV}{mr_0^2\Omega^2},\ q' = \frac{4eV_q}{mr_0^2\Omega^2} = \frac{V_q}{V}q,$$

$$A = \frac{eV_d}{2mr_0\Omega^2}\ \nu = \frac{\omega_d}{\Omega},\ \nu' = \frac{\omega_q}{\Omega}$$

wherein c represents the damping coefficient, u represents the motion in the x or y direction of the ion, $\xi=\Omega_r/2$, representing the time dimension. $V_d$ represents the amplitude of the quadrupolar electric field, $\omega_d$ represents the frequency of the quadrupolar excitation signal, $V_q$ represents the magnitude of the dipolar electric field, $\omega_q$ represents the frequency of the dipolar excitation signal, V represents the magnitude of the main RF electric field, and Ω represents the RF frequency, m represents the ion mass, $r_0$ represents the field radius and U represents the applied DC voltage. The ions are excited by applying an auxiliary quadrupolar electric field, and the applied auxiliary quadrupolar electric field splits the first stable region of the Matthew equation into "islands of stability."

As shown in FIG. 3(*a*), taking v'=⅓, q'=0.01 as an example, the stable region forms an unstable region along the iso-β line at β=⅓ and β=⅔, respectively. The width of the unstable region is related to the magnitude of the applied electric field. When the ion motion frequency and the resonant frequency satisfy Kv=|v+β|, v=0, ±1, ±2 . . . , K=1, 2, 3 . . . , wherein K is a parameter representing the levels of excitation, the ions will be excited. If the applied quadrupolar electric field intensity is large, the ions will be ejected. FIG. 3(*b*) shows a spectral analysis of the equation. The addition of a quadrupolar electric field introduces the coupling term of the quadrupolar field frequency ($\beta_q$) and the ion motion frequency ($\beta_0$), as well as the coupling term of the quadrupolar field frequency ($\beta_q$) and the dipolar excitation frequency ($\beta_d$), which is summarized to include the following: 2 $m\pm(n\beta_q\pm\beta_0)$, 2 $m\pm(n\beta_q\pm\beta_d)$, m=0, ±1, ±2 . . . , n=0, ±1, ±2 . . . . When $\beta_q=2\beta_0$, $\beta_0=\beta_d$; $\beta_q=\beta_0$, $\beta_0=\beta_d$, a nonlinear resonance occurs between the quadrupolar field and dipolar field, so that ions are quickly excited to achieve an effect of improving the performance of the instrument, FIGS. 3(*c*), 3(*d*), 3(*e*) show the simulation on the ion trajectory of the excitation method. It can be seen that in the case that the dipolar electric field and the quadrupolar electric field are simultaneously applied, the amplitude of the movement of the ions is greater than that in the case either the dipolar electric field or the quadrupolar electric field is applied alone.

Figure 4A:
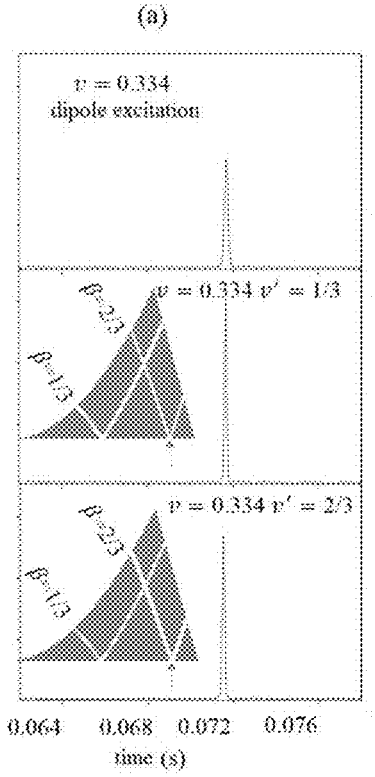
FIGS. 4(*a*), 4(*b*) and 4(*c*) are signal intensity diagrams at three quadrupolar excitation frequencies.
Figure 4B:
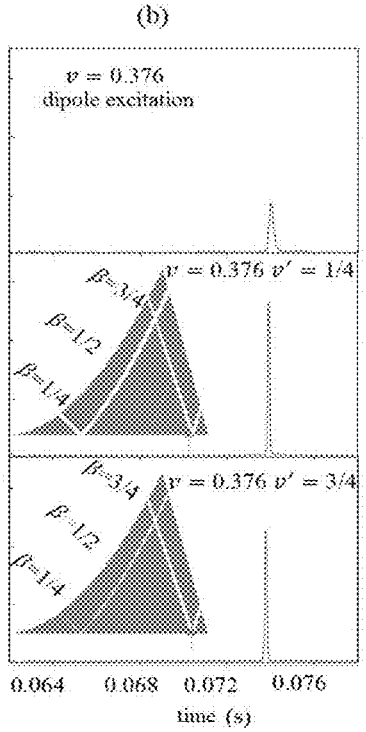
Figure 4C:
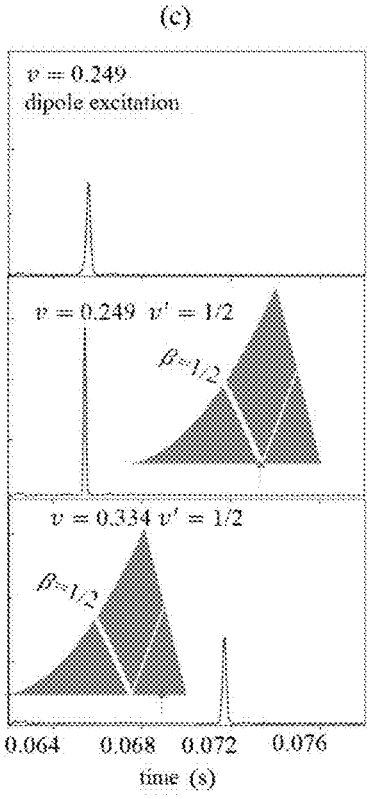

The method of the examples of the present invention can be applied to a sine wave frequency scanning miniature mass spectrometer and compared with the results of dipolar excitation tests. The ion source used to generate the ions is an electrospray ion source (ESI), the mass analyzer is a linear ion trap, and the samples used are MRFA, reserpine, and bradykinin. FIGS. 4(*a*)-4(*c*) show a quadrupolar enhanced excitation point. FIG. 4(*a*) shows when the quadrupolar excitation frequency is at ⅓, the quadrupolar excitation electric field forms an unstable region at β=⅓, ⅔, when a dipolar electric field with a certain intensity is applied in the unstable region, the intensity of the ion signal is significantly increased. FIG. 4(*b*) shows when the quadrupolar electric field excitation frequency is at ¼, the quadrupolar excitation electric field forms an unstable region at β=¼, ¾, ¾, when a dipolar electric field with a certain intensity is applied in the unstable region, the intensity of the ion signal is significantly increased. FIG. 4(*c*) shows when the quadrupolar excitation frequency is at ½, the quadrupolar excitation electric field forms an unstable region at β=½, when a dipolar electric field with a certain intensity is applied in the unstable region, the ion signal intensity is significantly increased. If a dipolar electric field is still applied at β=⅔, the signal enhancement effect will not be seen, which illustrates the enhancement effect of the quadrupolar electric field.

Figure 5A:
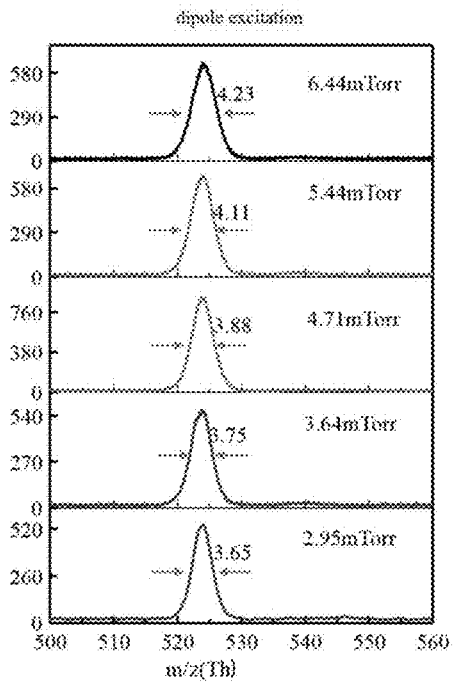
FIGS. 5(*a*) and 5(*b*) are diagrams comparing a conventional dipolar excitation at different pressures and the quadrupolar electric field combined with dipolar electric field excitation of the present invention.
Figure 5B:
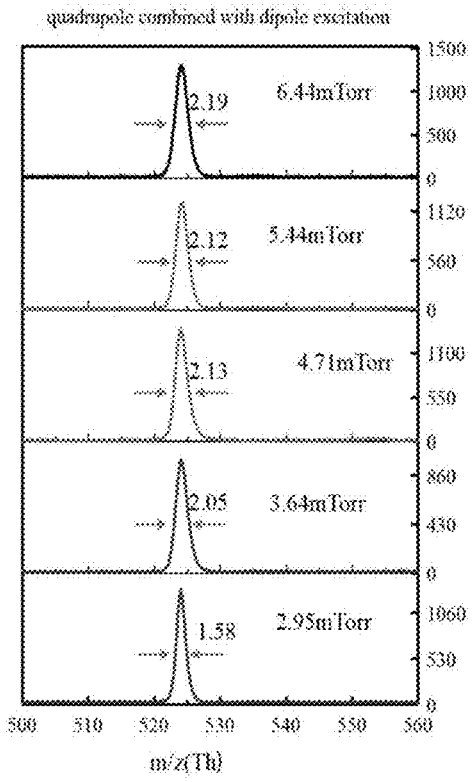
Figure 6A:
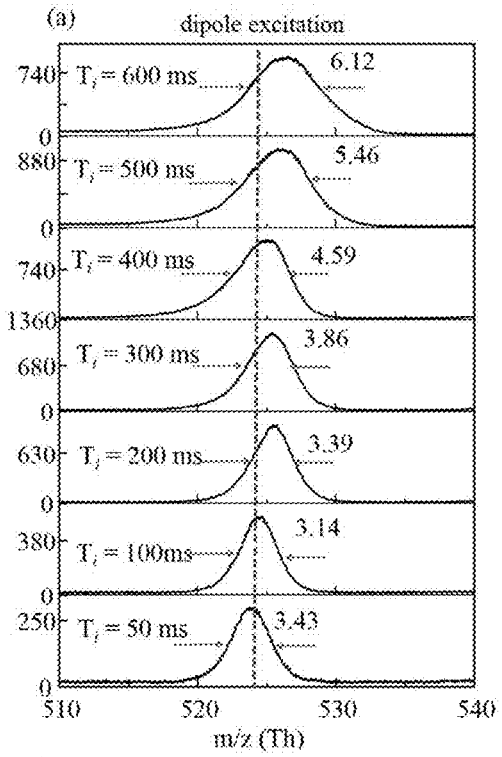
FIGS. 6(*a*), 6(*b*), 6(*c*) and 6(*d*) are diagrams comparing conventional dipolar excitation and the quadrupolar electric field combined with dipolar electric field excitation of the present invention at different injection time.
Figure 6B:
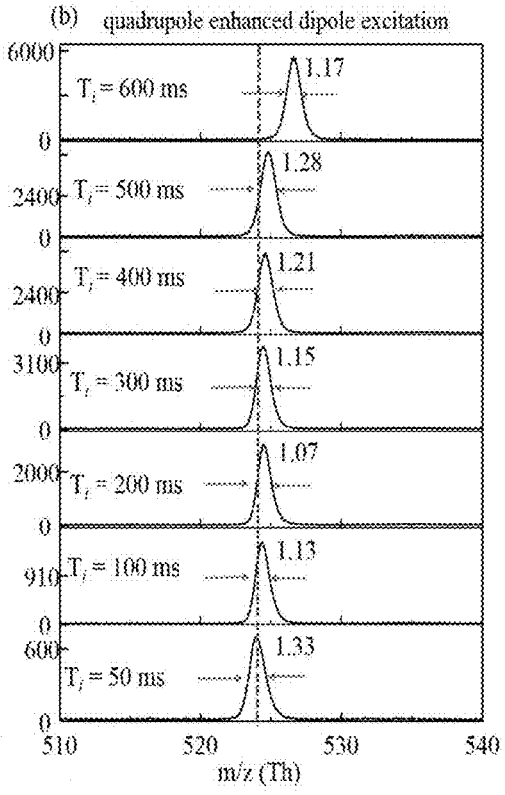
Figure 6C:
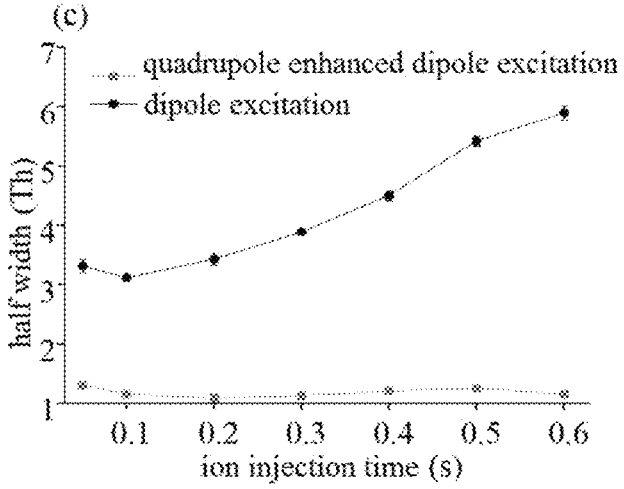
Figure 6D:
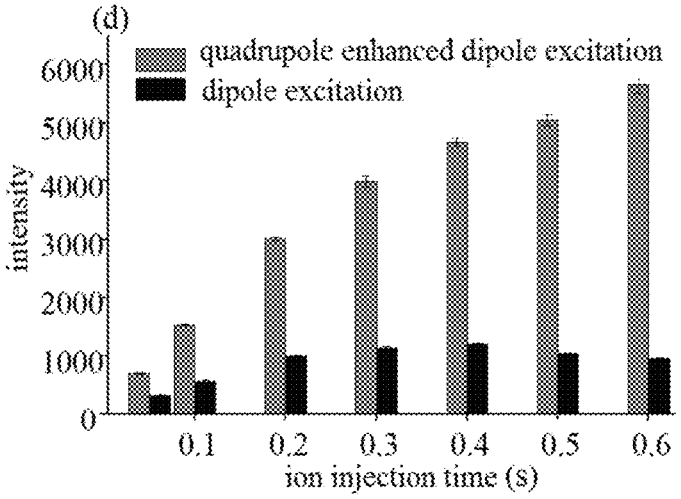
Figure 7A:
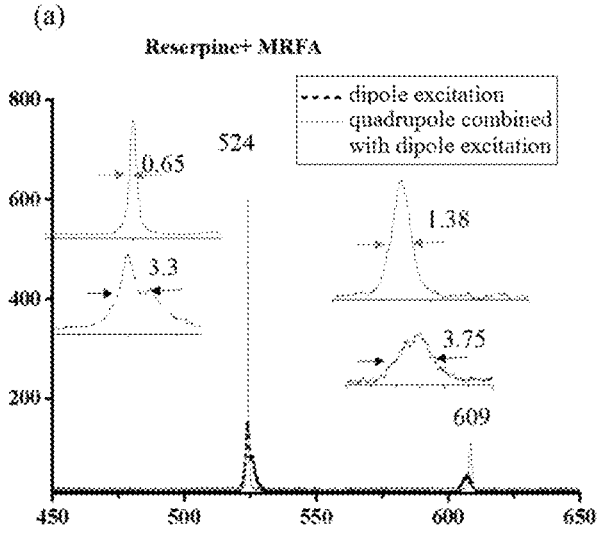
FIGS. 7(*a*) and 7(*b*) are comparison diagrams between a mixture of MRFA and reserpine, and bradykinin.
Figure 7B:
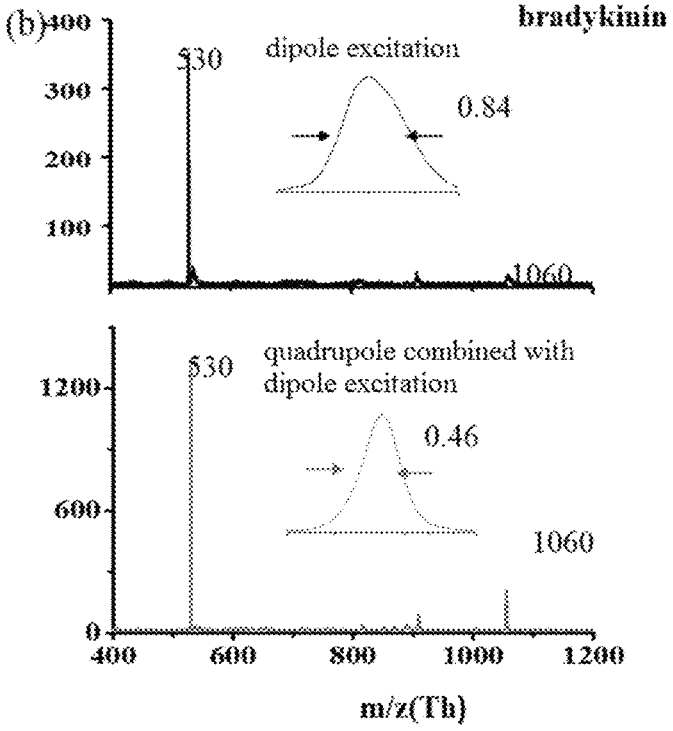
Figure 8A:
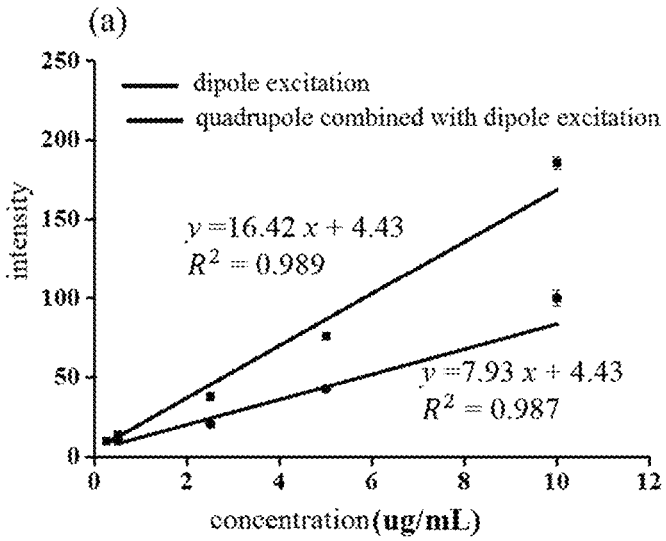
FIGS. 8(*a*) and 8(*b*) are concentration comparison diagrams between a conventional dipolar excitation and the quadrupolar electric field combined with dipolar electric field excitation of the present invention.
Figure 8B:
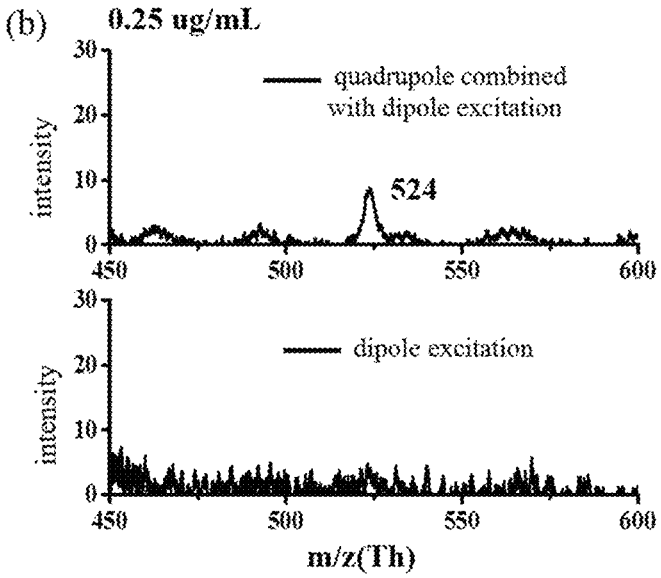

FIGS. 5(*a*) and 5(*b*) compare the conventional dipolar excitation mode with the quadrupolar electric field combined with dipolar electric field excitation mode provided by the examples of the present invention at different air pressures. Under the same pressure, the resolution of the quadrupolar electric field combined with the dipolar electric field excitation mode is higher than that of conventional dipolar excitation mode, with about 2 times increase. FIGS. 6(*a*) and 6(*b*) show a test on the half-width of the two modes at different injection time T, indicating the effect of the space charge effect on the two solutions. For the conventional dipolar excitation, the half-width of the ions increases with increase of the injection time, and for the quadrupolar electric field combined with the dipolar electric field excitation, as the injection time increases, the resolution of the change is small and the signal intensity is also improved. FIGS. 7(*a*) and 7(*b*) show a test on a mixture of MRFA and reserpine. The peak width of MRFA is reduced from 3.3 Da to 0.65 Da. The half width of reserpine is reduced from 3.75 Da to 1.38 Da. The half width of bradykinin is reduced from 0.84 Da to 0.46 Da. The half widths are effectively suppressed. The quadrupolar electric field combined with the dipolar electric field excitation mode can greatly improve the signal intensity. FIGS. 8(*a*) and 8(*b*) show the sensitivity of the instrument. Compared with the dipolar excitation mode, the sensitivity of the quadrupolar electric field combined with the dipolar electric field excitation mode can be increased by about 2 times.

In addition, an example of the present invention further provides an ion resonance excitation operation method by applying a quadrupolar electric field combined with a dipolar electric field, which is used for a quadrupole, and the method comprises (the recited steps can be performed in any order or simultaneously):

applying a positive main RF to a pair of electrode rods of the quadrupole and applying a negative main RF to the other pair of electrode rods; and applying a quadrupolar excitation signal to any pair of electrode rods and applying a reverse phase dipolar excitation signal to any pair of electrode rods.

Correspondingly, an example of the present invention provides an ion resonance excitation device by applying a quadrupolar electric field combined with a dipolar electric field, the device comprises: a quadrupole, a positive main RF, a negative main RF, a quadrupolar excitation signal source, and a dipolar excitation signal source. The positive main RF is applied to a pair of electrode rods of the quadrupole, and the negative main RF is applied to the other pair of poles of the quadrupole; the quadrupolar excitation signal source and the dipolar excitation signal source are applied to any pair of electrode rods of the quadrupole, respectively.

Figure 9A:
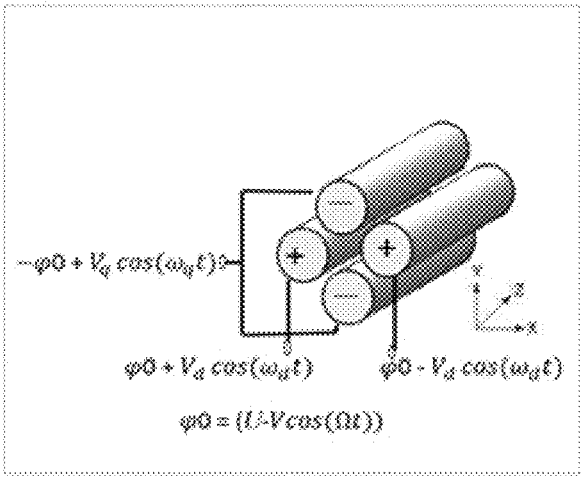
FIGS. 9(*a*) and 9(*b*) are electrical signal application diagrams showing applying a quadrupolar excitation signal and a dipolar excitation signal to a quadrupole.
Figure 9B:
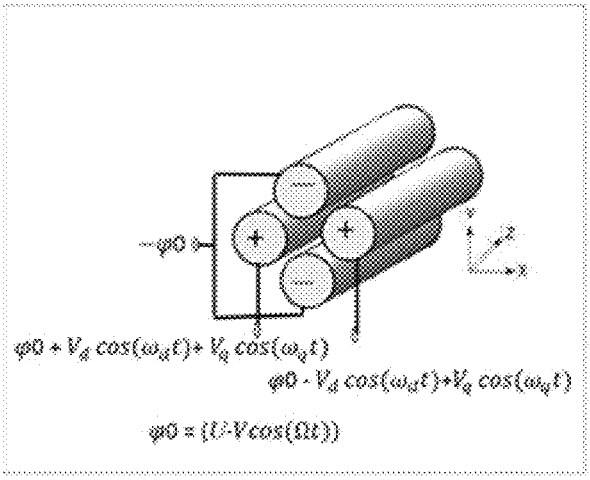

The ion resonance excitation operation method and device by applying a quadrupolar electric field combined with a dipolar electric field in the operation mode of the quadrupole can improve the resolution of the quadrupole mass spectrometer. In the operation mode of the quadrupole, the quadrupolar excitation signal can be applied to the main RF in the form of coupling, or applied to the main RF of the quadrupole in the form of amplitude or frequency modulation to divide the stable region into unstable islands. FIGS. 9(*a*) and 9(*b*) are diagrams showing applying a quadrupolar excitation signal and a dipolar excitation signal to the quadrupole.

φ0 is the main RF signal applied to the quadrupole, wherein $\varphi 0=(U-V\cos(\Omega t))$, U is the DC applied to the quadrupole. As shown in the left diagram of FIG. 9, a positive main RF φ0 is applied in the x direction, a negative main RF− is applied in the y direction, and a reverse phase dipolar excitation signal $V_d\cos(\omega_d t)$ is applied to a pair of electrode rods in the x direction, and a quadrupolar excitation signal $V_q\cos(\omega_q t)$ is applied to a pair of electrode rods in the x direction. It can be seen that the dipolar excitation signal is applied in the x direction of the quadrupole, and the quadrupolar excitation signal is applied in the y direction of the quadrupole. It is also possible to apply a quadrupolar excitation signal in the x direction or in both x and y directions. Illustratively, as shown in the right side of FIG. 9, both the dipolar excitation signal and the quadrupolar excitation signal are simultaneously applied in the x direction.

The ion resonance excitation operation method and device by applying the quadrupolar electric field combined with the dipolar electric field provided by the examples of the invention can be applied to the quadrupole, thereby improving the resolving power of the quadrupole mass spectrometer.

Although the invention and its advantages have been described in detail, it is understood that without departing from the spirit and scope of the appended claims as defined in the present invention that various modifications, substitutions and changes can be made. Moreover, the scope of the present application is not limited to the specific examples of processes, systems, devices, methods and steps described in the specification. A person skilled in the art based on the disclosure of the present invention will readily understand that in accordance with the present invention they can use processes, equipment, means, methods and steps to implement similar functions as the examples described herein or obtain similar results. Therefore, the appended claims intend to encompass such processes, equipments, means, methods and steps within their scope.

What is claimed is:

1. An ion resonance excitation operation method by applying a quadrupolar electric field combined with a dipolar electric field for an ion trap mass analyzer, comprising:

applying a main radio frequency signal having a first frequency and a first amplitude to any pair of plates of the ion trap mass analyzer; and applying a quadrupolar excitation signal having a second frequency and a second amplitude to any pair of plates and applying a reverse phase dipolar excitation signal having a third frequency to any pair of plates, wherein the second amplitude is from 0.1% to 1.2% of the first amplitude.

2. The method of claim 1, wherein the second amplitude is from 0.8% to 1.2% of the first amplitude.

3. The method according to claim 2, wherein the second frequency is 1/n of the first frequency, where n is an integer greater than one.

4. The method of claim 1, wherein the third frequency of the dipolar excitation signal is within +/−3 k Hz of a frequency corresponding to an unstable region generated by the quadrupolar excitation signal.

5. An ion resonance excitation operation method comprising:

applying a positive main radio frequency signal having a first frequency and a first amplitude to a pair of electrode rods of the quadrupole and applying a negative main radio frequency to the other pair of electrode rods; and applying a quadrupolar excitation signal having a second frequency and a second amplitude to any pair of electrode rods and applying a reverse phase dipolar excitation signals to any pair of electrode rods, wherein the second amplitude is from 0.1% to 1.2% of the first amplitude, wherein the second frequency is 1/n of the first frequency, where n is an integer greater than one.

6. An ion resonance excitation device by applying a quadrupolar electric field combined with a dipolar electric field, comprising:

ion trap mass analyzer, main radio frequency, quadrupolar excitation signal source, dipolar excitation signal source;

wherein the main radio frequency is applied with a first frequency and a first amplitude to any pair of plates of the ion trap mass analyzer; the quadrupolar excitation signal source is applied to any pairs of plates with a second frequency and a second amplitude to any pair of plates of the ion trap mass analyzer, and the dipolar excitation signal source is applied to any pair of plates of the ion trap mass analyzer, and wherein the second amplitude is from 0.1% to 1.2% of the first amplitude, and wherein the second frequency is 1/n of the first frequency, where n is an integer greater than one.

7. An ion resonance excitation device by applying a quadrupolar electric field combined with a dipolar electric field, comprising:

quadrupole, positive main radio frequency, negative main radio frequency, quadrupolar excitation signal source, dipolar excitation signal source;

wherein the positive main radio frequency is applied with a first frequency and a first amplitude to a pair of electrode rods of the quadrupole, and the negative main radio frequency is applied to the other pair of electrode rods of the quadrupole; the quadrupolar excitation signal source is applied to any pairs of plates with a second frequency and a second amplitude any pair of plates of the ion trap mass analyzer, and the dipolar excitation signal sources is applied to any pair of electrode rods of the quadrupole, wherein the second amplitude is from 0.1% to 1.2% of the first amplitude, and wherein the second frequency is 1/n of the first frequency, where n is an integer greater than one.

* * * * *